US011220984B2

(12) United States Patent
Shehan et al.

(10) Patent No.: US 11,220,984 B2
(45) Date of Patent: Jan. 11, 2022

(54) ELECTRONIC FUEL INJECTION THROTTLE BODY ASSEMBLY

(71) Applicant: Holley Performance Products, Inc., Bowling Green, KY (US)

(72) Inventors: Laura Shehan, Bowling Green, KY (US); Amy Gieske, Loogootee, IN (US); Jonathan Sams, Woodburn, KY (US); Adam Layman, Alvaton, KY (US); Douglas Flynn, Bowling Green, KY (US)

(73) Assignee: Holley Performance Products, Inc., Bowling Green, KY (US)

( * ) Notice: Subject to any disclaimer, the term of this patent is extended or adjusted under 35 U.S.C. 154(b) by 0 days.

(21) Appl. No.: 17/090,212

(22) Filed: Nov. 5, 2020

(65) Prior Publication Data

US 2021/0054813 A1 Feb. 25, 2021

Related U.S. Application Data

(63) Continuation of application No. 16/389,227, filed on Apr. 19, 2019, now Pat. No. 10,830,195, which is a (Continued)

(51) Int. Cl.
*F02D 9/02* (2006.01)
*F02M 51/06* (2006.01)

(Continued)

(52) U.S. Cl.
CPC ..... *F02M 51/06* (2013.01); *F02D 9/02* (2013.01); *F02D 9/1035* (2013.01); *F02D 41/30* (2013.01);

(Continued)

(58) Field of Classification Search
CPC .. F02M 51/06; F02M 69/043; F02D 41/3005; F02D 41/30; F02D 9/02; F02D 9/1035; F02D 2400/11

(Continued)

(56) References Cited

U.S. PATENT DOCUMENTS 4,224,908 A 9/1980 Bier et al.
4,230,645 A 10/1980 Dodson (Continued)

FOREIGN PATENT DOCUMENTS

AU 339157 10/2011
AU 341133 2/2012

(Continued)

OTHER PUBLICATIONS

U.S. Appl. No. 29/628,392 entitled "EFI Throttle Body" filed Dec. 4, 2017.

(Continued)

*Primary Examiner* — Hai H Huynh
(74) *Attorney, Agent, or Firm* — Middleton Reutlinger

(57) ABSTRACT

Present embodiments provide a throttle body which may be used with a variety of engines of different manufacturers. The throttle body may be used to replace mechanical or hydraulically controlled carburetors with electronic fuel injection. The throttle body may provide improved fuel pathways through and about the throttle body in order to move fuel to opposed side. The throttle bodies may have improved configuration of the fuel injectors. Further, the throttle body may have computer mounted on the throttle body and a notch formed in the throttle body to define a wire routing pathway from the computer to the injectors.

15 Claims, 14 Drawing Sheets

Related U.S. Application Data continuation of application No. 15/795,981, filed on Oct. 27, 2017, now Pat. No. 10,294,902.

(60) Provisional application No. 62/414,139, filed on Oct. 28, 2016.

(51) Int. Cl.
*F02D 41/30* (2006.01)
*F02M 69/04* (2006.01)
*F02D 9/10* (2006.01)

(52) U.S. Cl.
CPC ..... *F02D 41/3005* (2013.01); *F02M 69/043* (2013.01); *F02D 2400/11* (2013.01)

(58) Field of Classification Search
USPC ..... 123/470, 468, 469, 336, 337, 195 C
See application file for complete search history.

(56) References Cited

U.S. PATENT DOCUMENTS

| | | | | |
|---|---|---|---|---|
| 4,246,875 | A | 1/1981 | Bier et al. | |
| 4,294,282 | A | 10/1981 | McCabe et al. | |
| 4,306,441 | A | 12/1981 | Dodson | |
| 4,318,214 | A | 3/1982 | Dodson | |
| 4,325,339 | A | 4/1982 | Bier et al. | |
| 4,357,283 | A | 11/1982 | Manning | |
| 4,434,762 | A | 3/1984 | McCabe | |
| 4,434,763 | A | 3/1984 | McCabe et al. | |
| 4,556,032 | A | 12/1985 | Miller | |
| 4,949,983 | A | 8/1990 | Miller | |
| 5,261,382 | A | 11/1993 | Nikolai | |
| 5,408,978 | A | 4/1995 | Davis | |
| D447,147 | S | 8/2001 | Grant | |
| 6,467,465 | B1 | 10/2002 | Lorts | |
| 6,481,698 | B1 | 11/2002 | Calvin et al. | |
| D508,496 | S | 8/2005 | Grant | |
| D543,555 | S | 5/2007 | Braswell et al. | |
| D555,668 | S | 11/2007 | Benoit | |
| D578,550 | S | 10/2008 | Benoit | |
| 7,533,661 | B2 | 5/2009 | Baasch | |
| 7,591,245 | B2 | 9/2009 | Baasch et al. | |
| D645,058 | S | 9/2011 | Benoit | |
| D648,746 | S | 11/2011 | Tipton et al. | |
| D655,311 | S | 3/2012 | Gieske et al. | |
| D659,714 | S | 5/2012 | Gieske et al. | |
| D721,389 | S | 1/2015 | Gieske et al. | |
| 9,115,671 | B2 | 8/2015 | Benoit | |
| 9,303,578 | B2 | 4/2016 | Wittkopf et al. | |
| 9,376,997 | B1 | 6/2016 | Farrell et al. | |
| D760,804 | S | 7/2016 | Shehan et al. | |
| 9,482,198 | B1 | 11/2016 | Farrell et al. | |
| 9,845,740 | B2 | 12/2017 | Wittkopf et al. | |
| D808,435 | S | 1/2018 | Shehan et al. | |
| D810,142 | S | 2/2018 | Shehan et al. | |
| 10,012,197 | B2 | 7/2018 | Flynn et al. | |
| D826,280 | S | 8/2018 | Koo et al. | |
| 10,094,353 | B2 | 10/2018 | Bennett et al. | |
| 10,830,195 | B2 * | 11/2020 | Shehan | F02D 9/02 |
| 2009/0145406 | A1 | 6/2009 | Farrell et al. | |
| 2011/0120413 | A1 | 5/2011 | Runia | |
| 2013/0298871 | A1 | 11/2013 | Bennett et al. | |
| 2015/0108256 | A1 | 4/2015 | Flynn et al. | |
| 2017/0198672 | A1 | 7/2017 | Farrell et al. | |
| 2018/0119656 | A1 | 5/2018 | Shehan et al. | |
| 2021/0071592 | A1 | 3/2021 | Shehan et al. | |

FOREIGN PATENT DOCUMENTS

| | | |
|---|---|---|
| AU | 348732 | 5/2013 |
| AU | 348733 | 5/2013 |
| AU | 348734 | 5/2013 |
| AU | 356762 | 8/2014 |
| AU | 201710470 | 2/2017 |
| AU | 201710471 | 2/2017 |
| AU | 2013254906 | 11/2017 |
| AU | 201813353 | 8/2018 |
| AU | 201813355 | 8/2018 |
| AU | 201815034 | 9/2018 |
| AU | 201815036 | 9/2018 |
| AU | 201816623 | 12/2018 |
| AU | 201816624 | 12/2018 |
| CN | 101568711 | 4/2013 |
| EM | 003729599 | 1/2017 |

OTHER PUBLICATIONS

Holley Performance Products, Inc., 2017 New & Hot Products Catalogue—Carburetors, Nov. 1, 2016.
U.S. Appl. No. 62/594,526 entitled "Electronic Fuel Injection Throttle Body Assembly" filed Dec. 4, 2017.
Australian Patent Application No. 2017251869 entitled "Electronic Fuel Injection Throttle Body Assembly" filed Oct. 30, 2017.
U.S. Appl. No. 62/594,527 entitled "Electronic Fuel Injection Throttle Body Assembly" filed Dec. 4, 2017.
U.S. Appl. No. 29/628,394 entitled "EFI Throttle Body" filed Dec. 4, 2017.
U.S. Appl. No. 62/669,052 entitled "Electronic Fuel Injection Throttle Body Assembly" filed May 3, 2018.
U.S. Appl. No. 15/986,571 entitled "Fuel Injection Throttle Body" filed May 22, 2018.
U.S. Appl. No. 16/208,246 entitled "Electronic Fuel Injection Throttle Body Assembly" filed Dec. 3, 2018.
U.S. Appl. No. 29/647,068 entitled "Electronic Fuel Injection Throttle Body" filed May 9, 2018.
U.S. Appl. No. 62/669,094 entitled "Electronic Fuel Injection Throttle Body Assembly" filed May 9, 2018.
U.S. Appl. No. 62/726,723 entitled "Electronic Fuel Injection Throttle Body Assembly" filed Sep. 4, 2018.
Mopar Performance P5249686 Jeep MPI-Fuel, Sep. 2, 2016.
Howell EFI Fuel Injection Conversion Kit, JP258, Apr. 29, 2015.
F.A.S.T. EZ-EFI Self-Tuning Fuel Injection Systems 30294-Kit TBI Conversion Kit, Jun. 30, 2015.
U.S. Appl. No. 16/208,231 entitled "Electronic Fuel Injection Throttle Body Assembly" filed Dec. 3, 2018.
International Search Report and Written Opinion for PCT/US2018/063660 dated Mar. 20, 2019.
International Search Report and Written Opinion for PCT/US2018/063668 dated Mar. 20, 2019.
Canadian Design Patent Application No. 184483 entitled "Electronic Fuel Injection Throttle Body" filed Oct. 31, 2018.
Canadian Design Patent Application No. 184482 entitled "Electronic Fuel Injection Throttle Body" filed Oct. 31, 2018.
Mexican Design Patent Application No. MX/f/2018/003332 entitled "Electronic Fuel Injection Throttle Body" filed Nov. 8, 2018.
Mexican Design Patent Application No. MX/f/2018/003333 entitled "Electronic Fuel Injection Throttle Body" filed Nov. 8, 2018.
U.S. Appl. No. 29/647,060 entitled "Electronic Fuel Injection Throttle Body" filed May 9, 2018.

* cited by examiner

ELECTRONIC FUEL INJECTION THROTTLE BODY ASSEMBLY

CLAIM TO PRIORITY

This continuation patent application claims priority to and benefit of, under 35 U.S.C. § 120, U.S. patent application Ser. No. 16/389,227, filed Apr. 19, 2019, titled "Electronic Fuel Injection Throttle Body Assembly", which claims priority to U.S. Continuation patent application Ser. No. 15/795,981, filed Oct. 27, 2017, titled "Electronic Fuel Injection Throttle Body Assembly", which claims priority to U.S. Provisional Application No. 62/414,139, filed Oct. 28, 2016, titled "Carburetor Retrofit Fuel Injection System", all of which is incorporated by reference herein.

CROSS-REFERENCE

This application incorporates by reference, in their entireties, the enabling disclosures of U.S. Pat. No. 9,376,997 entitled "EFI Throttle Body With Side Fuel Injectors," U.S. Pat. No. 9,115,671 entitled "Hybrid carburetor and fuel injection assembly for an internal combustion engine," U.S. patent application Ser. No. 14/156,813 entitled "Fuel Injection Throttle Body," U.S. Design Pat. application. No. 29/572,684 entitled "EFI Throttle Body," and U.S. Design Pat. application. No. 29/572,692 entitled "EFI Throttle Body."

BACKGROUND

Field of the Invention

Present embodiments related to throttle body fuel injection systems intended to replace existing carburetors. More specifically, present embodiments relate to retrofitting carbureted engines with electronic fuel injection (EFI) which may be mounted on a manifold of an internal combustion engine and have numerous features including small size, improved performance, ease of installation and the like.

Description of the Related Art

Replacement throttle body systems are utilized to provide carburetor replacement while having improved performance of electronic fuel injection. This is desirable for higher performance engines or improving performance and consistency of older engines.

However, when installing these systems, there are multiple variables related to size of throttle body, space on the engine and relative to the vehicle hood, space relative to surrounding engine components.

Prior art devices are often fully mechanical or hydraulic which over time can lead to decrease in proper function. Further, variations in atmospheric temperature and pressure, engine temperature, load and speed are all variable rendering difficult to maximize efficiency and/or performance of prior art carburation. For example, cold engine condition, an engine at idle, and an engine at wide-open throttle all require a rich fuel-air mixture. However, warm engine at cruise requires a lean fuel-air mixture. The airflow also varies greatly, as much as 100 times, between wide-open throttle and idle condition. Still another variable may be fuel formulations and characteristics.

It would be desirable to improve consistency of operation with an engine throttle body to improve carburetion while also improving performance and/or efficiency.

It would also be desirable to provide a throttle body which may be used with a variety of engine manufacturers and fit within engine compartments of a variety of vehicles.

The information included in this Background section of the specification, including any references cited herein and any description or discussion thereof, is included for technical reference purposes only and is not to be regarded subject matter by which the scope of the invention is to be bound.

SUMMARY

Embodiments relate to carburetor retrofit fuel injection systems.

Present embodiments provide a throttle body assembly which may be used with a variety of engines of different manufacturers. The throttle body assembly may be used to replace mechanical or hydraulically controlled carburetors with electronic fuel injection. The throttle body assembly may provide improved fuel pathways through and about the throttle body in order to move fuel to opposed side. The throttle bodies may have improved configuration of the fuel injectors. Further, the throttle body may have computer mounted on the throttle body and a notch formed in the throttle body to define a wire routing pathway from the computer to the injectors.

It should be appreciated that the fuel injection system may include a main throttle body and one or more fuel component covers. These fuel component covers may be oriented on the right and left sides of the main body, the front and back sides, or in any other configuration. The fuel component covers may be fluidly coupled by an external fuel crossover tube or conduit. An external fuel crossover tube or conduit may provide flexibility in fuel routing, alleviate some potential packaging issues, avoid possible casting issues such as porosity, and is serviceable.

The system may be scalable for a single barrel, a two barrel application or a four barrel application, or more. The system may also be scalable as to the number of stacked fuel injectors based on the engine performance requirements.

According to some embodiments, an electronic fuel injection throttle body assembly comprises a throttle body having an upper inlet and a lower outlet configured to mount to an internal combustion engine, at least one bore extending through the throttle body, a first fuel injector disposed at least partially within the throttle body at a first position, a second fuel injector disposed at least partially within the throttle body at a second position, the second position substantially vertically aligned with the first position, the first fuel injector and the second fuel injector directing fuel into a channel of at least one fuel distribution ring, the at least one fuel distribution ring having a plurality of fuel apertures directing fuel into a bore of the throttle body, a throttle valve disposed within the bore and at a lower elevation than the fuel injectors toward the outlet side of the throttle body and, a throttle lever assembly disposed on a side of the throttle body, a shaft extending from the throttle lever assembly toward the bore to control a position of the throttle valve.

Optionally, the following features may be used with the EFI throttle body assembly either alone or in combination with other of the following features. The at least one bore may be two bores, each of the bores having a valve and the first and second injectors. The at least one bore may be four bores, wherein each of the bores has a valve and the first and second injectors. The electronic fuel injection throttle body assembly may further comprise an electronic control unit in electrical communication with the first and second fuel injectors. The electronic fuel injection throttle body assembly may further comprise at least one fuel component cover with fuel passages therein, the at least one fuel component cover being connectable to the throttle body for fuel communication with the fuel injectors. The electronic fuel injection throttle body assembly may further comprise a second fuel component cover. The at least one fuel component cover and the second fuel component cover may be connected by an external fuel conduit. The fuel injectors may extend in an alignment direction which is parallel to the shaft. The fuel injectors may extend in a downward direction through the throttle body.

According to some embodiments an electronic fuel injection throttle body assembly, comprises a throttle body having an upper inlet side and a lower outlet side, the throttle body configured to mount to an internal combustion engine, at least one bore may extend through the throttle body, a fuel component cover located on a first side of the throttle body having: a lower fuel inlet passage, a connecting fuel passage extending upwardly from the fuel inlet passage to an upper fuel passage, the upper fuel passage delivering fuel to an external fuel conduit extending from the fuel component cover to at least one of a second side of the throttle body or a pressure regulator; an electronic control unit mounted to the throttle body and a cover mounted over the electronic control unit, the cover and the electronic control unit positioned on a side of the throttle body other than the first side and the second side.

Optionally, the following features may be used with the EFI throttle body assembly either alone or in combination with other of the following features. The electronic fuel injection throttle body assembly may further comprise a second fuel component cover on a second side of the throttle body. The second fuel component cover may have a second fuel inlet in communication with the external fuel conduit. The electronic fuel injection throttle body assembly may further comprise the pressure regulator disposed in fluid communication with the second inlet at the second side of the throttle body. The electronic fuel injection throttle body assembly may further comprise an outlet in fluid communication with the pressure regulator. The electronic fuel injection throttle body assembly wherein the pressure regulator is concealed within and removable from a second fuel component cover. The electronic control unit may be mounted to the throttle body, mounted within the cover or a combination thereof. The pressure regulator may be one of mounted in a second fuel component cover or an externally mounted pressure regulator.

According to some embodiments, an electronic fuel injection throttle body assembly comprises a throttle body having an upper inlet side and a lower outlet side, the throttle body configured to mount to an internal combustion engine, at least one bore extending through the throttle body, a fuel inlet passage located on one side of the throttle body, an external fuel conduit which passes fuel from the first fuel inlet on the one side, to a second fuel inlet passage on a second side, a fuel outlet on the second side, an electronic control unit mounted to the throttle body and a cover mounted over the electronic control unit, the cover and the electronic control unit mounted on a side of the throttle body other than the first side and the second side, a notched area of the throttle body defining a wire pathway from the electronic control unit to within a covered area having at least one fuel injector.

Optionally, the electronic control unit may be one of mounted to the throttle body, mounted within the cover or a combination thereof.

All of the above outlined features are to be understood as exemplary only and many more features and objectives of a throttle body fuel injection system or assembly may be gleaned from the disclosure herein. Therefore, no limiting interpretation of this summary is to be understood without further reading of the entire specification, claims and drawings, included herewith.

BRIEF DESCRIPTION OF THE DRAWINGS

In order that the embodiments may be better understood, embodiments of the throttle body fuel injection system will now be described by way of examples. These embodiments are not to limit the scope of the claims as other embodiments of the throttle body fuel injection system will become apparent to one having ordinary skill in the art upon reading the instant description. Non-limiting examples of the present embodiments are shown in figures wherein:

DETAILED DESCRIPTION

Figure 1:
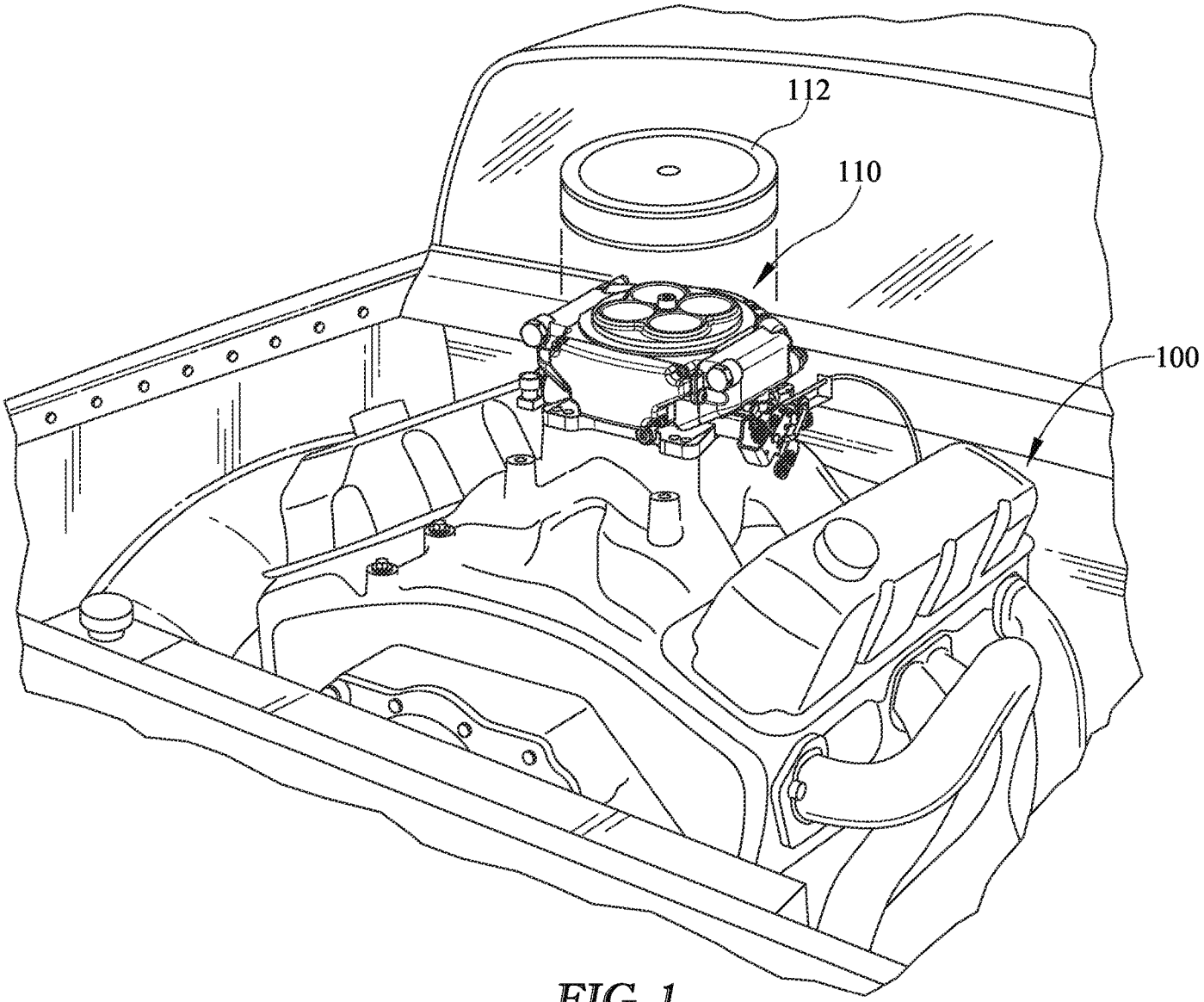
FIG. 1 is a perspective view of a combustion engine and an electronic fuel injection throttle body assembly.

It is to be understood that the electronic fuel injection throttle body assembly is not limited in its application to the details of construction and the arrangement of components set forth in the following description or illustrated in the drawings. The throttle body assembly is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed there-after and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Referring now in detail to the drawings, wherein like numerals indicate like elements throughout several views, there are shown in FIGS. 1-13 various embodiments of a throttle body fuel injection system. Present embodiments pertain to an electronic fuel injection throttle body assembly which may be used to retrofit older throttle body assemblies.

With reference to FIG. 1, a partial perspective view of an engine compartment is depicted wherein a combustion engine 100 is provided with an electronic fuel injection (EFI) throttle body assembly 110 and an air filter 112. The engine is illustrative as one or more throttle body assemblies 110 may be utilized and one or more filter configurations may be used to deliver air to the one or more throttle body assemblies 110. The combustion process, as one of skill in the art will be aware, combines fuel and air with an ignition source. The instant throttle body assembly 110 is mounted to the engine 100 directly such as at the manifold and receives air through the air filter 112 and receives fuel from a fuel tank and mixes the two for the ignition which occurs the engine 100. In other embodiments, the assembly 110 may be mounted to the engine indirectly such as to a supercharger.

The EFI throttle body assembly 110 is configured to be compact allowing use in a variety of configurations. Due to the wide variety of engine manufactures and vehicle types and sizes, it is desirable to provide a structure which may be used in many of these vehicles/engines. This also requires consideration of space relative to the engine hood and space relative to surrounding engine components. It may also be desirable to provide a device of minimal height, for example less than 6 inches, a forward to rear length of less than about 10 inches and a side to side length of less than 11 inches. These dimensions are merely illustrative of a non-limiting embodiment, but provide a compact design desirable for use across many engine sizes and vehicle types.

Figure 2:
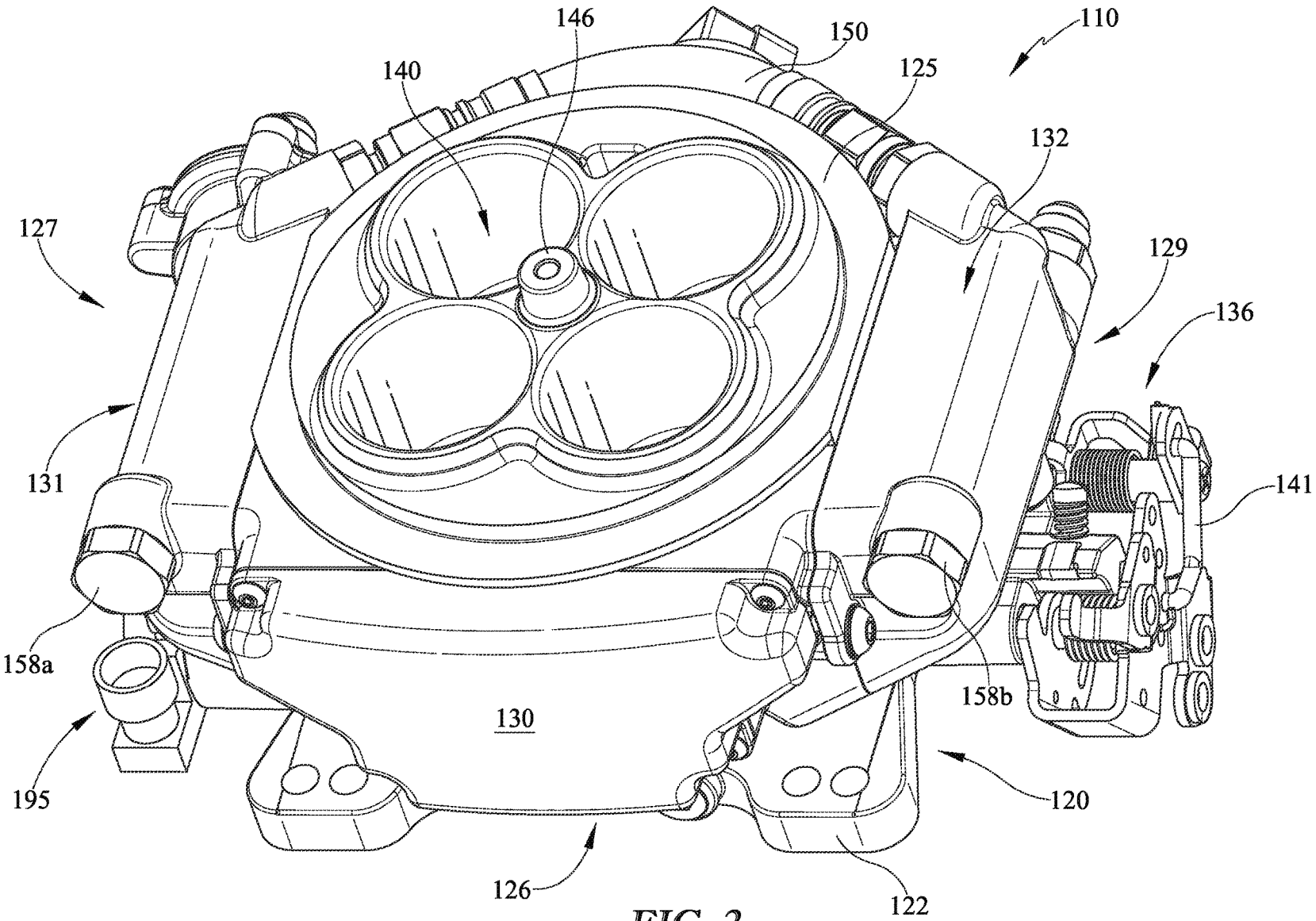
FIG. 2 is an upper perspective view of the electronic fuel injection throttle body assembly removed from the engine.

With reference to FIG. 2, a front upper perspective view of the carburetor is shown. The throttle body assembly 110 includes a throttle body 120 including a mounting base 122 and a main body 124 (FIG. 3) which extends upwardly from the base 122. A stand 146 is provided between the bores 140 which supports a fastener (not shown) extending through the throttle body 120. The fastener extends up for engagement and connection of the air filter 112 (FIG. 1). The upper end of the main body 124 (FIG. 3) may include an upper flange 125. This may define a seat or upper limit for positioning of air intake structure above the throttle body assembly 110. The base 122 may have a plurality of holes for mounting the assembly 110 wherein the multiple holes provide various known bolt patterns.

The base 122 may also include various pipe ports where for example some vehicle engines require vacuum ports. For example, a manifold vacuum port, distributor spark and other may be provided along, or near the base 122 and on the throttle body 120. The ports may be plugged at time of manufacture and unplugged by the end user to make these ports functional.

The depicted embodiment shows a four barrel throttle body assembly 110, however, the present throttle body assembly 110 is scalable so that it may include one barrel, two barrels, four barrels as shown or more. These barrels 140 are also referred to as bores 140 throughout this description. Additionally, more than one throttle body assembly 110 may be used in the engine depending on the engine type and configuration of intakes.

Figure 3:
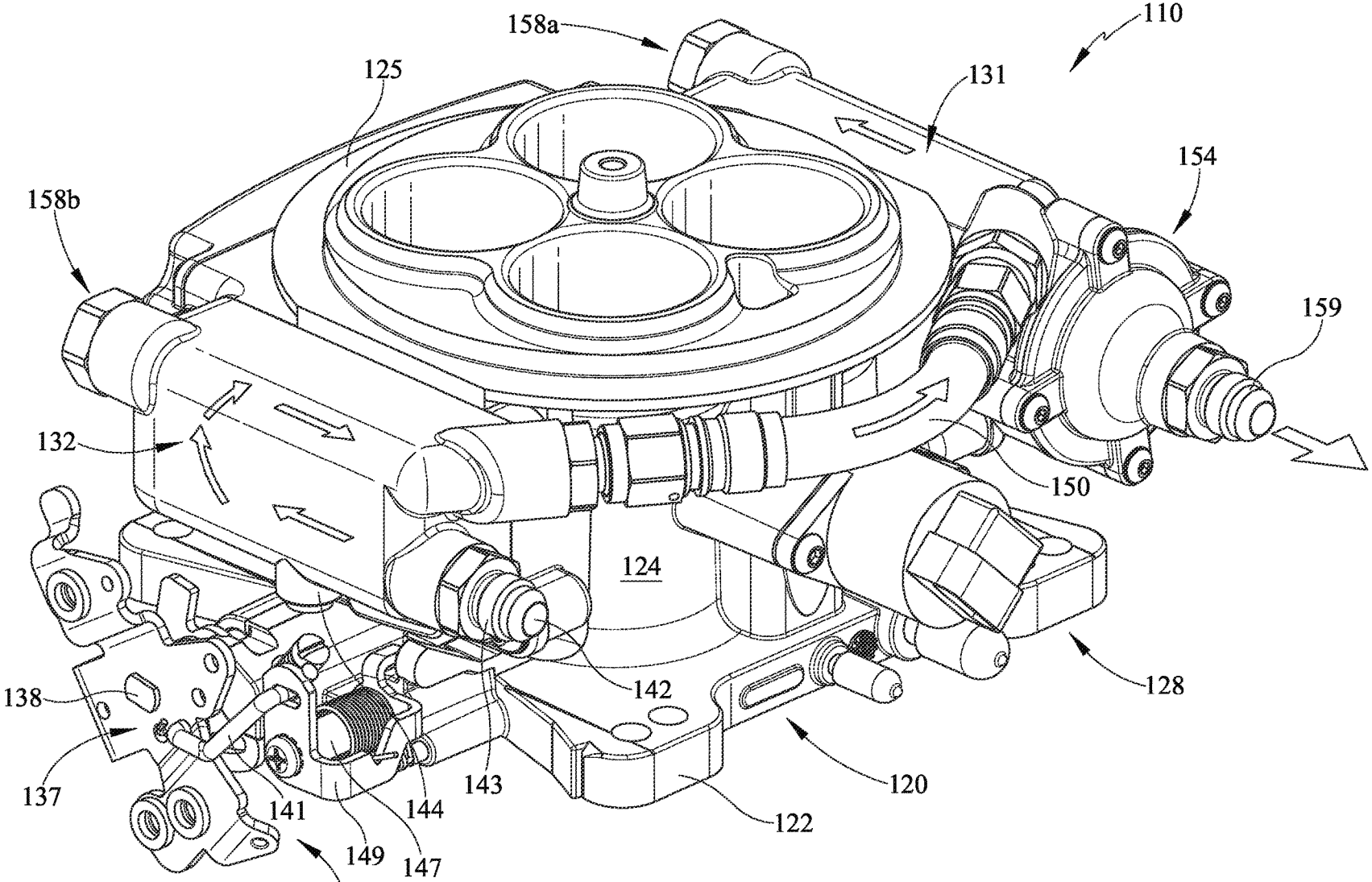
FIG. 3 is rear perspective view of the electronic fuel injection throttle body assembly.

The front of the throttle body assembly 110 is shown in the instant view. For purpose of reference of description, but not limiting, the front 126 of the throttle body assembly 110 is shown and the rear 128 is shown in FIG. 3. The front 126 of the throttle body assembly 110 may include a cover 130. The cover 130 conceals and contains an electronic control unit 190, which is mounted to the throttle body 120 or within the cover 130, or a combination thereof.

The throttle body 120 also comprises sides 127, 129 (FIG. 2) which are labeled for ease of reference in description. The throttle body sides 127, 129 include fuel components which also function as covers. The fuel component covers 131, 132 are mounted on the right and left sides of the throttle body 120, but may also be on the front and back sides or other configurations. The fuel component covers 131, 132 provide a cover for fuel pathways and define the fuel passageways therein. The fuel component covers 131, 132 are fastened to the throttle body 120 and the front cover 130 is mounted and fastened to the front of the body 120 therebetween. Again, the sides may differ in mounting position in other embodiments.

In addition to the fuel passage componentry in the component covers 131, 132, these structures also cover fuel injectors 1170 (FIGS. 11, 13) and mounted therein and extending into the throttle body 120. Thus the cover functionality. With the electronic control unit cover 130 positioned adjacent to the component covers 131,132, the wire extending between the electronic control unit 190 (FIG. 12) and any of the fuel injectors 1170 which are located in any of the fuel injection ports 170-173 and 170'-173' (FIGS. 4, 5, 7) may be hidden by routing beneath the covers 130, 131, 132. This is desirable for clean appearance and installation as well as inhibiting damage to the wiring, which controls function of the throttle body assembly 110.

Further for purpose of clarification, the fuel injector 1170 (FIG. 13) is representative of a fuel injector which is mounted in any of the fuel injector ports 170-173 and 170'-173' located within the throttle body 120. It should be understood that in some views the fuel injectors may be referred to for purpose of description of structure or functionality, but may be only represented by the port. That is, the fuel injector may be removed for some clarity of the description.

Also shown extending between the fuel component covers 131, 132 is an external fuel conduit 150 which provides a fuel pathway from one side of the throttle body 120 to a second side, in this instance from side 129 to side 127. The fuel conduit 150 is not contained within the body 120 and is not cast or machined in the body 120. Thus the conduit may also be considered modular as it is replaceable and may further be capable or re-routing if necessary.

Also shown at the lower side 129 of the assembly 110 is a throttle lever assembly 136. The assembly 136 is in communication with a mechanical linkage for example, which causes movement of the lever assembly 136 and specifically a shaft 138 connected to the lever assembly 136. With rotation of the shaft 138 (FIG. 5), valve plates 139 (FIG. 5) located within the at least one bore 140 may rotate based on fuel/air demand. At the opposite side of the throttle body 120, from the lever assembly 136 may be a throttle position sensor 195 which provides communication to the electronic control unit 190 concealed by the cover 130.

Referring now to FIG. 3, a rear perspective view of the throttle body assembly 110 is shown. Along the side 129 the throttle lever assembly 136 is shown from an opposite side of FIG. 2. The throttle lever assembly 136 may comprise a throttle lever 137 which is bracketed or fastened, to a shaft 138. In embodiments with four bores 140, or barrels, a second shaft may be operated by using the lever 137 to drive a throttle link 141 and rotate a second lever 149 and shaft 147. In the instant embodiment, all of the throttle lever assembly 136 is provided on a single side of the throttle body assembly 110. This inhibits interference of moving parts with other non-moving parts such as wires. This also make easier the wire routing process, so that only one area has to be avoided.

Figure 4:
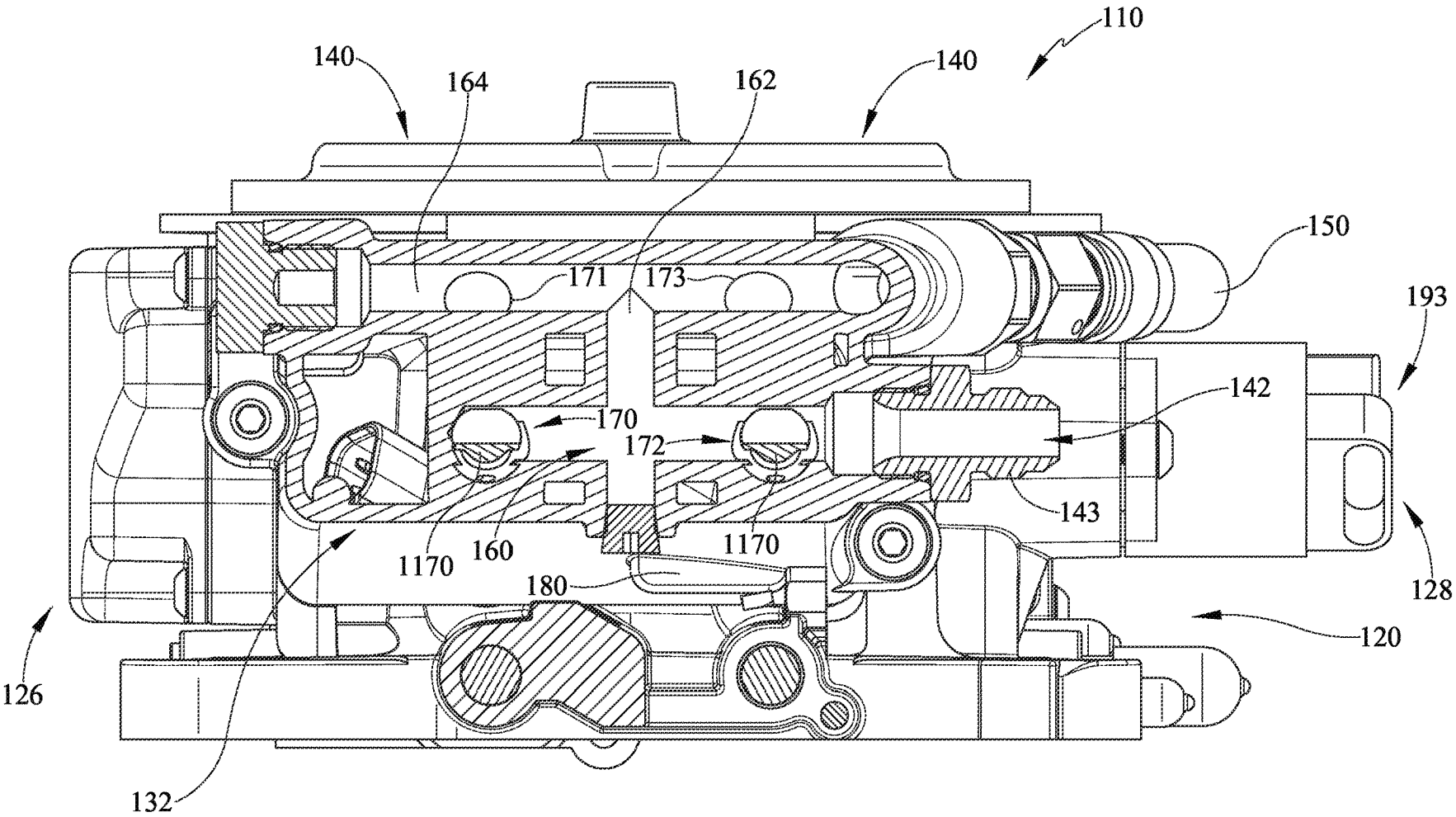
FIG. 4 is a side sectional view of the electronic fuel injection throttle body assembly depicting the internal area of the fuel component cover.

The fuel component cover 132 is also shown in FIG. 3. The fuel component cover 132 comprises a fitting 143 which defines a fuel inlet 142. In one embodiment, each fuel component cover 131, 132 may have two parallel passages 160, 164 (FIG. 4). These fuel passages may be oriented primarily horizontally and may be connected with the component cover by one or more internal connecting passages 162 (FIG. 4) which may be primarily vertical. The internal connecting passage may serve to equalize system pressure, or if a single fuel supply is used for the system, the internal connecting passage may distribute fuel.

An external accessory port 144 may be used to accommodate accessories such as instrumentation like pressure gauges, pressure transducers and the like. Other accessories may be outfitted as well.

Large double-line arrows are shown on the exterior of the fuel component cover to depict fuel flow therein. The fuel flow passes from the inlet 142 into the component cover 132 and continues horizontally through the lower passage. Once the lower passage fills with fuel, the fuel follows a vertical passage which leads to the upper passage. The upper passage fills with fuel and the fuel moves to the external fuel conduit 150 and around the throttle body 120 to the opposite side where the second component cover 131 is positioned. The component cover 131 receives fuel in the upper passage, and then moves to the lower passage through the vertical passage therein. Connected to the component cover 131 is a pressure regulator 154. This pressure regulator 154 can be set to allow fuel to flow from the outlet of the component cover 131 when the fuel pressure reaches a certain level. A fitting 159 is also shown in fluid communication with the regulator 154 to allow fluid flow return to the fuel tank.

Also shown in FIGS. 2-3 are auxiliary inlet 158*a*, 158*b* plugs or fittings. The auxiliary inlets 158*a*, 158*b* allow for an alternate fuel inlet location, which may be desirable depending on the engine configuration and fuel line location. For example, the fuel supply line may be split with a Y or T and directed into the inlets 158*a*, 158*b*. Further to the extent this is done, and since the conduit 150 is modular, the external conduit may be removed and the outlets of the fuel component covers 131,132 plugged.

Advantageously, fuel may be supplied from an external source to the top fuel passage or bottom fuel passage. For example if an engine uses a dropped base air cleaner, fuel may be supplied to the bottom fuel passage for additional clearance. Conversely, if there are space constraints near the base 122 of the throttle body 120, for instance plumbing for a nitrous system or the like, then fuel may be supplied to a top fuel passage. As discussed below, in one embodiment, different fuels or fluids may be supplied simultaneously to the top and bottom fuel passages. The fuel passages may be sized the same as an external supply hose that connects with the system to optimize fuel flow to the one or more fuel injectors.

With reference now to FIG. 4, a partial side section view of the throttle body assembly 110 is shown the section taken through the fuel component cover 132. In this view, the previously described fuel flow can be more easily understood. Referring first to the fitting 143 may be a standard fitting such as an SAE or similar automotive fitting for ease of use and/or replacement. As fuel passes through the fitting 143 at the inlet 142, it moves into the lower passage 160. In this passage, within the fuel component cover 132, there is at least one fuel injector port 170 positioned per bore 140. In the instant embodiment, and for purpose of this discussion, four bores 140 are provided and each bore has two injector ports and injectors.

The first passage 160 provides fuel flow to two lower injector ports 170, 172 and the corresponding injectors. As the passage 160 fills with fuel, the fuel moves through the internal connecting passage 162. In the instant embodiment, the internal connecting passage 162 is substantially vertical but the passage need not be solely vertical as the path may also be angled or curved and changing elevation.

At the second elevation, the internal connecting passage 162 reaches the second passage 164. At this second elevation, the passage 164 extends laterally, to two additional fuel injector ports 171, 173 and the corresponding injectors. The fuel injector ports 171, 173 and respective injectors are vertically stacked above the lower injector ports 170, 172 and respective injectors. Thus for each bore 140, where two or more injectors are required for each bore 140, there is a stacked arrangement of injectors. The lower passage 160 provides fuel to the lower injector and the upper passage 164 provides fuel to the upper injector. As shown in the instant embodiment, there are two bores 140 on each side of an axis extending from front 126 to rear 128. Thus in the section view of FIG. 4, four injectors, 170-173 are delivered fuel from the passages 160, 164.

With reference to FIGS. 2-4, the injector ports 170-173 and the injectors are centered relative to each throttle body bore 140. Thus each injector directs fuel by way of a fuel flow path toward the center axis of the bore or barrel 140. In the stacked configuration, there may be two distinct channels defined by the main body and grooves in the sleeve 152, 252 (FIG. 6, 8) or there may be multiple stacked sleeves. This configuration is advantageous for several reasons. First, it may allow for greater overall volume of fuel injection. Second, it may provide more uniform injection of fuel into each groove as compared to a side-by-side injector configurations, where both injectors fire into a single channel. Finally, it may provide more consistent presentation of fuel to the air for more efficient mixing between atomized fuel and intake air especially in a high fuel volume application. For example, in one embodiment, the system could be controlled to use only certain injectors under certain loading or duty cycle conditions. For example, under idle or cruising, the assembly 110 may only utilize the lower four injectors, but under acceleration or heavy loading, the system may utilize all eight injectors. The system may control all 8 injectors independently to maximize power, fuel economy and/or emissions. Additionally, in one embodiment, the fuel channels may have different physical characteristics such as size, depth, orifice size, number, shape, etc. The configuration may allow for even greater control over engine tuning and operation.

After filling the upper passage 164, the fuel moves through the external crossover conduit 150 to the fuel component cover 131.

Also shown in this figure is a wire routing tray 180 which maintains cable routing between the electronic control unit 190 (FIG. 12) and other electronic components of the assembly 110. Specifically, the routing tray 180 may retain wires or cables which extend to the rear 128 of the assembly to an IAC motor 193 and an oxygen sensor (not shown) for non-limiting example.

Figure 5:
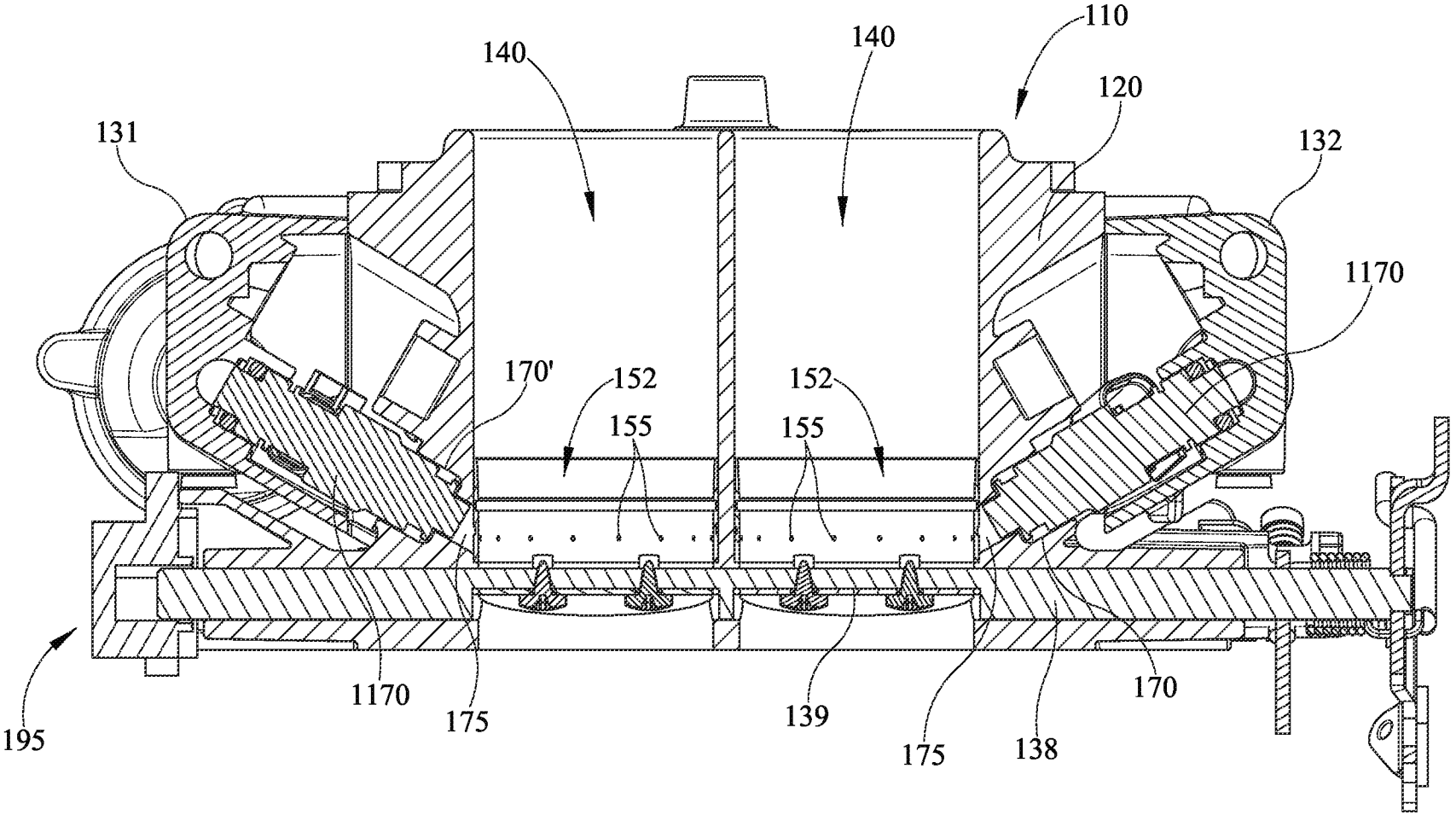
FIG. 5 is a side section view of the electronic fuel injection throttle body assembly depicting the positioning of the fuel injectors according to one embodiment.

Referring now to FIG. 5 one embodiment of the throttle body assembly 110 is depicted having a single horizontal row of fuel injector ports 170, 170' shown. In this embodiment, the section shows two of the four bores 140. The injector ports 170 and 170' and respective injectors are shown positioned in the throttle body 120 and inside the fuel component covers 132, 131, respectively.

The injectors 170, 170' deliver fuel as directed by the electronic control unit 190 to the bores 140. The bores 140 include apertures 175 through which the fuel passes to a fuel ring or sleeve 152. The ring or sleeve 152 is generally cylindrical in shape and has hollowed interior with open ends. The ring or sleeve 152 seals the hole 175 so that fuel is directed through channel 153 (FIG. 6) on the outer surface of the ring 152 and through apertures 155, into the bore 140. The ring or sleeve 152 in combination with the inner diameter of the bores 140 form the channel 153 (FIG. 6) wherein fuel passes to a plurality of apertures 155 located in the rings 152.

Figure 6:
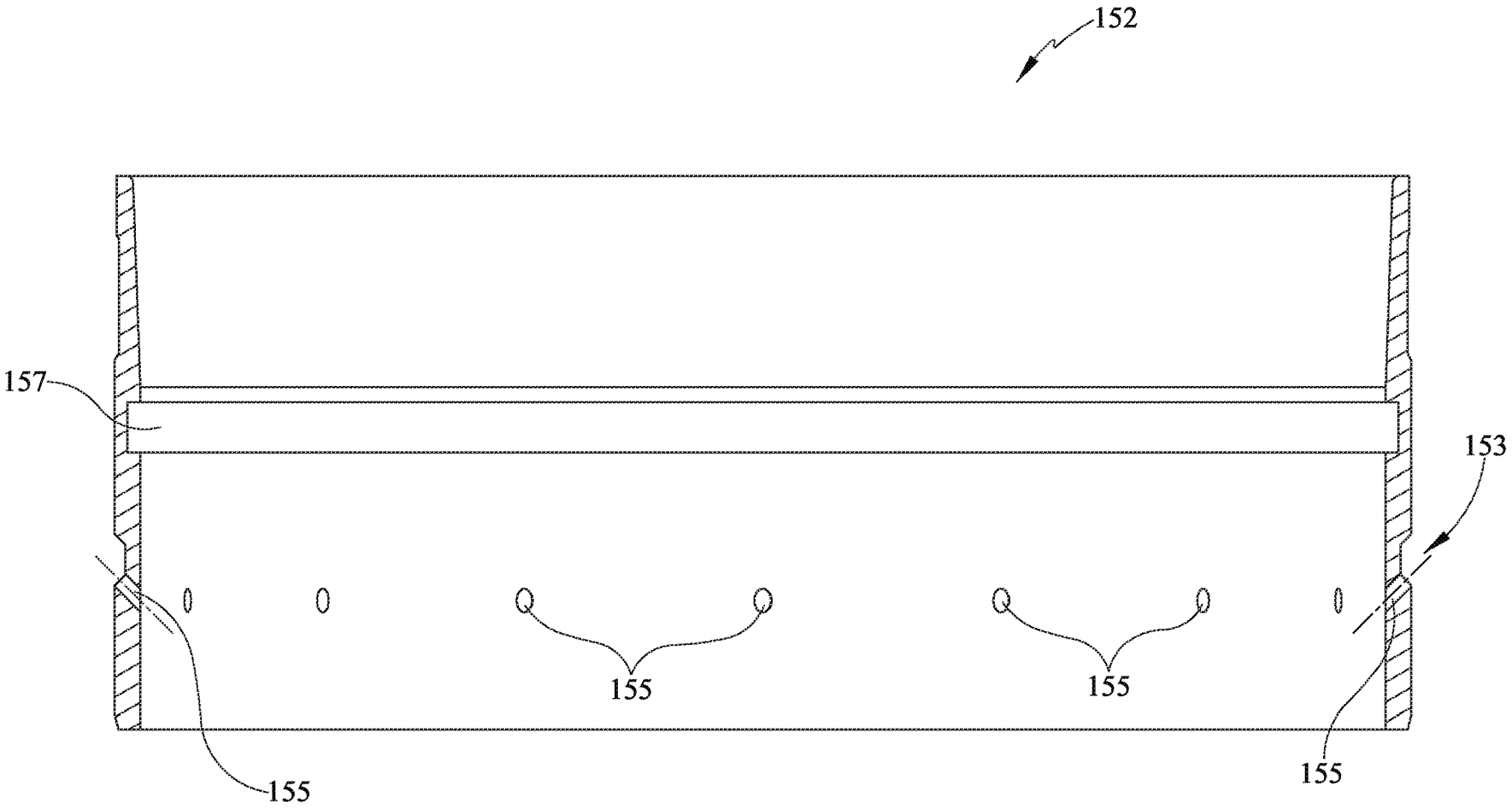
FIG. 6 is a side sectional view of a ring which is inserted into the bore of the throttle body according to the embodiment of FIG. 5.

With reference additionally to FIG. 6, a second view of one of the rings 152 is shown removed from the bore 140. The ring 152 includes a channel which extends circularly about the ring periphery at an elevation adjacent to the location of the injectors 1170. Also adjacent to the channel 153 are a plurality of the fuel apertures 155 which deliver fuel into the inner surface of the ring 152 and into the interior of the bore 140, radially inward of the ring 152. The apertures 155 direct fuel downward and in a radial direction into the center of the ring 152 and bore 140.

Also shown within the ring 152 is a groove 157 which may be used to move the ring 152 during installation. A tool may be inserted from one end of the bore 140 (FIG. 5) and expanded to engage an edge of the groove 157. Once engaged, the ring 152 may be forced upwardly, for example, or downward out of the bore, depending on the entrance direction of the tool.

As noted previously, the embodiment of FIGS. 5, 6 depict a single row of fuel injectors. Accordingly, there is a single row of apertures 155 in the ring 152. However, as also mentioned, some embodiments may include a second row of injectors in a second upper configuration. That is, each bore 140 may have two vertically arranged injectors and ports 170, 171 for example. The plurality of these upper injectors may be considered an upper row within the throttle body 120. Accordingly, a second row of apertures may be found on some rings.

Figure 7:
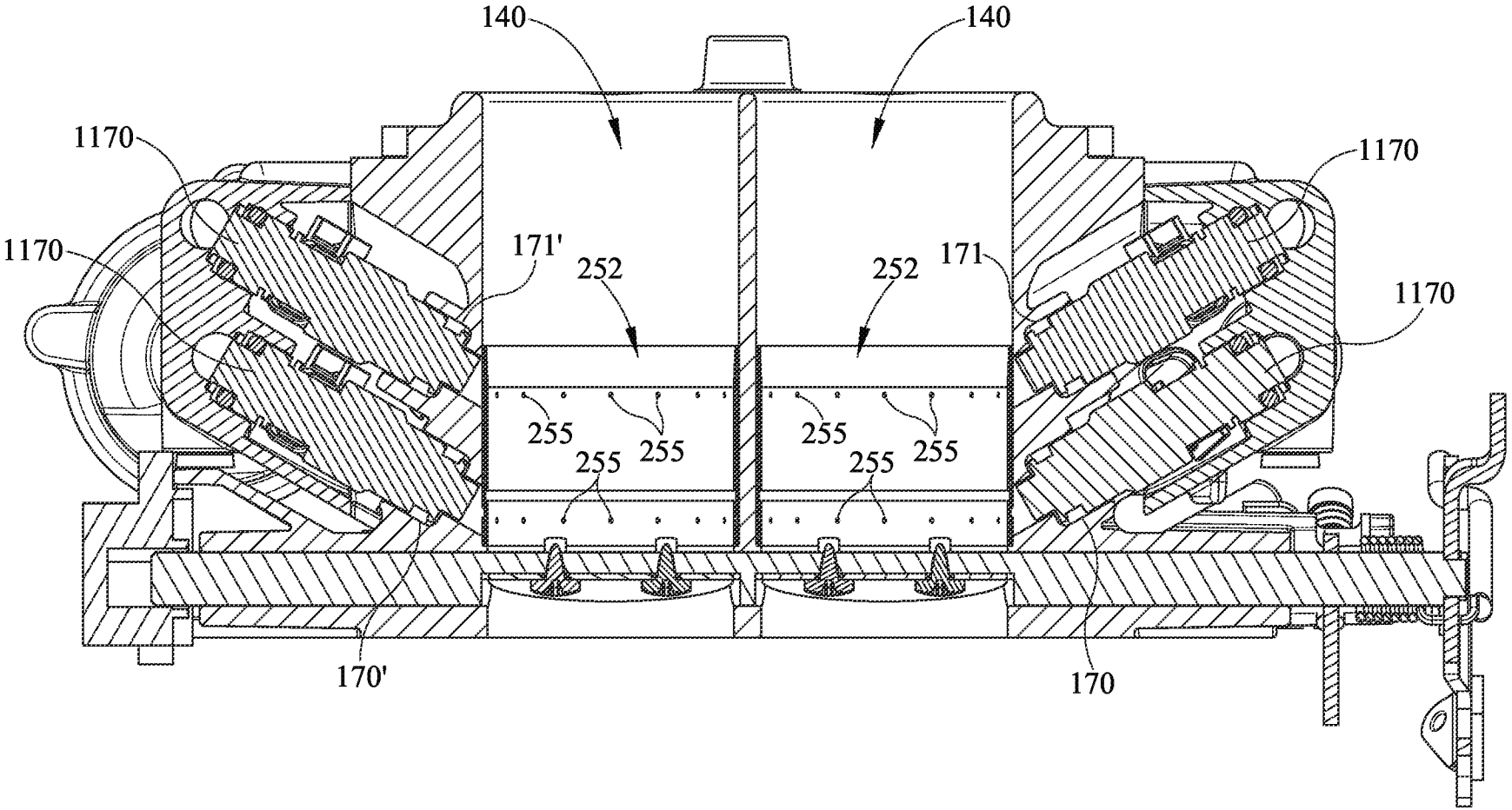
FIG. 7 is a side section view of the electronic fuel injection throttle body assembly depicting the positioning of the fuel injectors according to a second embodiment.
Figure 8:
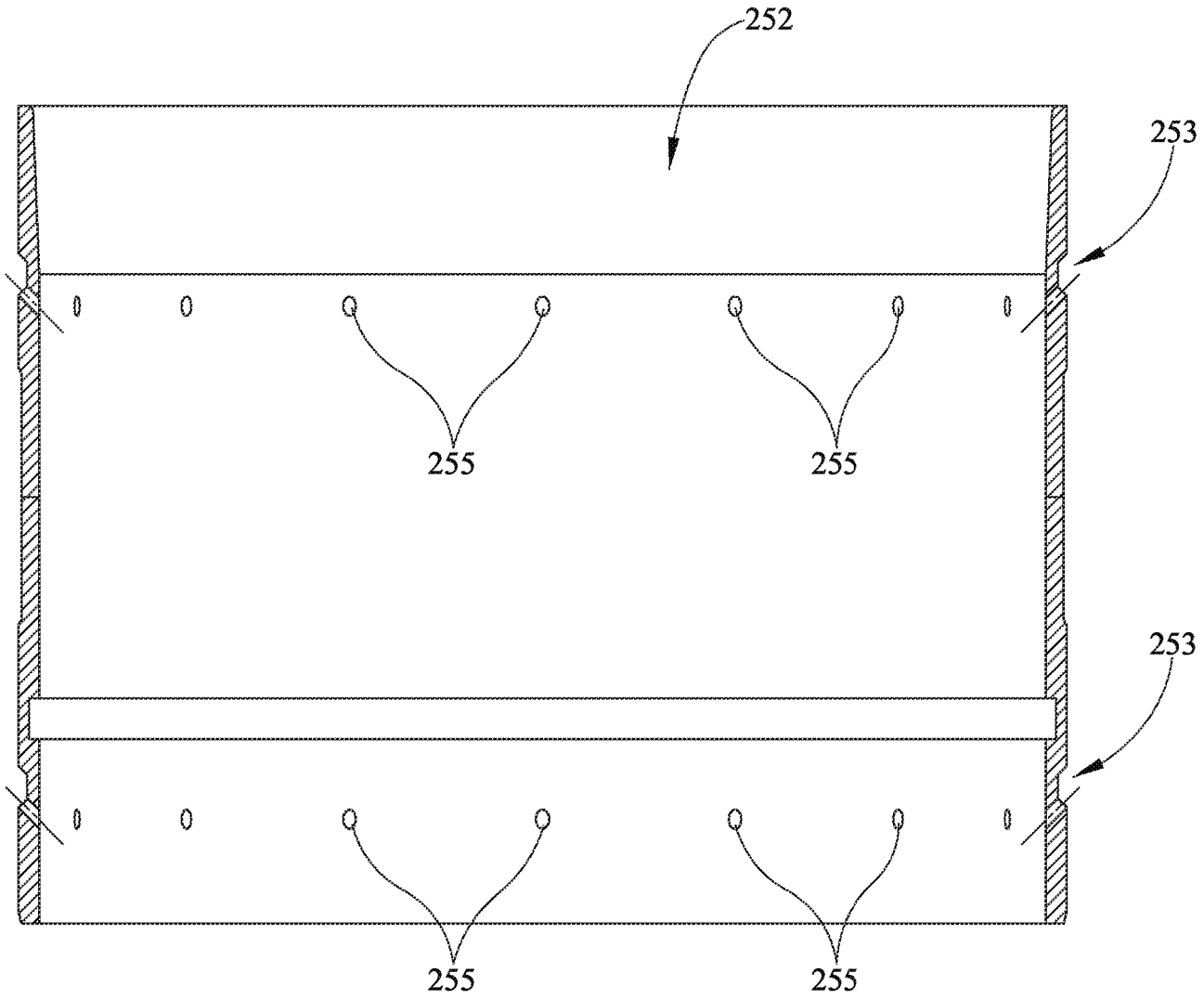
FIG. 8 is a side sectional view of a ring which is inserted into the bore of the throttle body, according to the embodiment of FIG. 7.

With this in mind, and now with reference to FIGS. 7-8, an alternative embodiment is shown having the first and second injectors in each bore 140. In this embodiment, each bore 140 comprises two injector ports 170, 171 and 170', 171'. Additionally, each port is shown having an injector 1170. The bores 140 each comprise a ring 252 which also includes two rows of fuel apertures 255, corresponding to the two ports 170, 171 and 170', 171' of each bore 140. As depicted, each ring has an upper row of apertures and a lower row of apertures which respectively correspond to the upper and lower injectors 1170 for example.

As shown more clearly in the section view of FIG. 8, the first and second rows of aperture 255 are disposed at two elevations. Each row of apertures 255 has a corresponding channel 253 extending about the periphery of the ring 252 adjacent to the corresponding row. In other words, there may be an upper channel for the upper row of apertures 255 and lower channel for the lower row of apertures 255. The ring 252 may also include a groove 257 as with the single row embodiment.

Either of these rings 152, 252 are substantially cylindrically shaped and hollow. The rings 152, 252 may be formed in the shape of a substantially cylindrically shaped inner wall or may alternatively have a venture shape. The upper ends of the rings 152, 252 may also have a slight taper along at least the outer surface to improve sealing of the rings within the bores 140.

Figure 12:
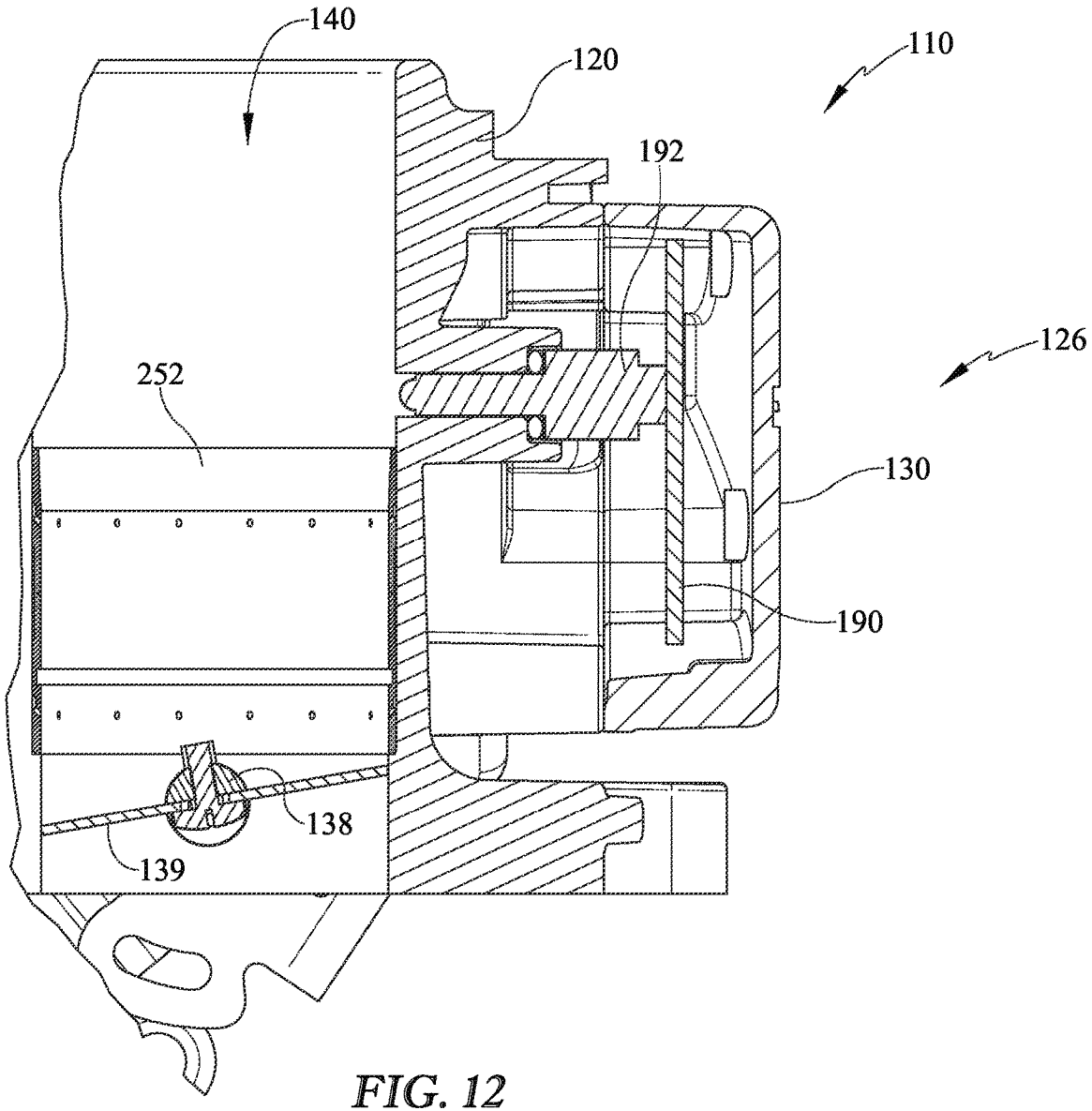
FIG. 12 is a partial section view of the throttle body assembly depicting the electronic control unit; and, FIG. 13 is a perspective view of the fuel injector and wiring connector.

Further, the height of the rings 152, 252 may also be shorter than the length of the bores 140. It may be desirable to keep the rings 152, 252 as short as possible and negate any need to machine an additional opening through the rings for an internal air temperature sensor 192, (FIG. 12).

With reference briefly to FIGS. 5 and 7, these views show a fuel injector alignment direction. The fuel injector alignment direction is considered to be a direction between first and second ends of the fuel injector, purely in a horizontal plane. In these views, the fuel injector alignment direction is shown as generally parallel to the shaft 138. Also, it should be understood that the fuel injector alignment direction is generally horizontal regardless of whether the fuel injector is horizontal, oriented upwardly toward the bores 140 or oriented downwardly toward the bores as shown.

Figure 9:
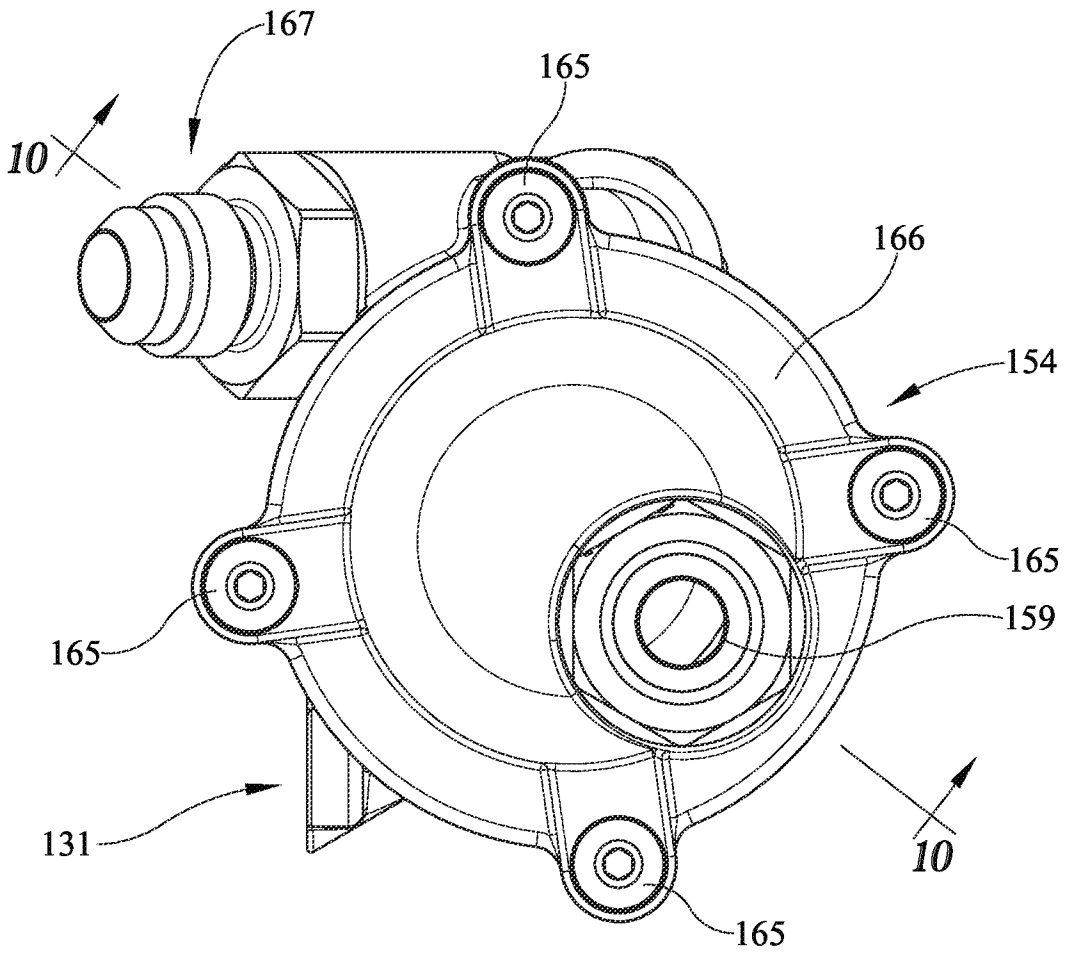
FIG. 9 is an end view of the pressure regulator cover of the electronic fuel injection throttle body assembly.
Figure 10:
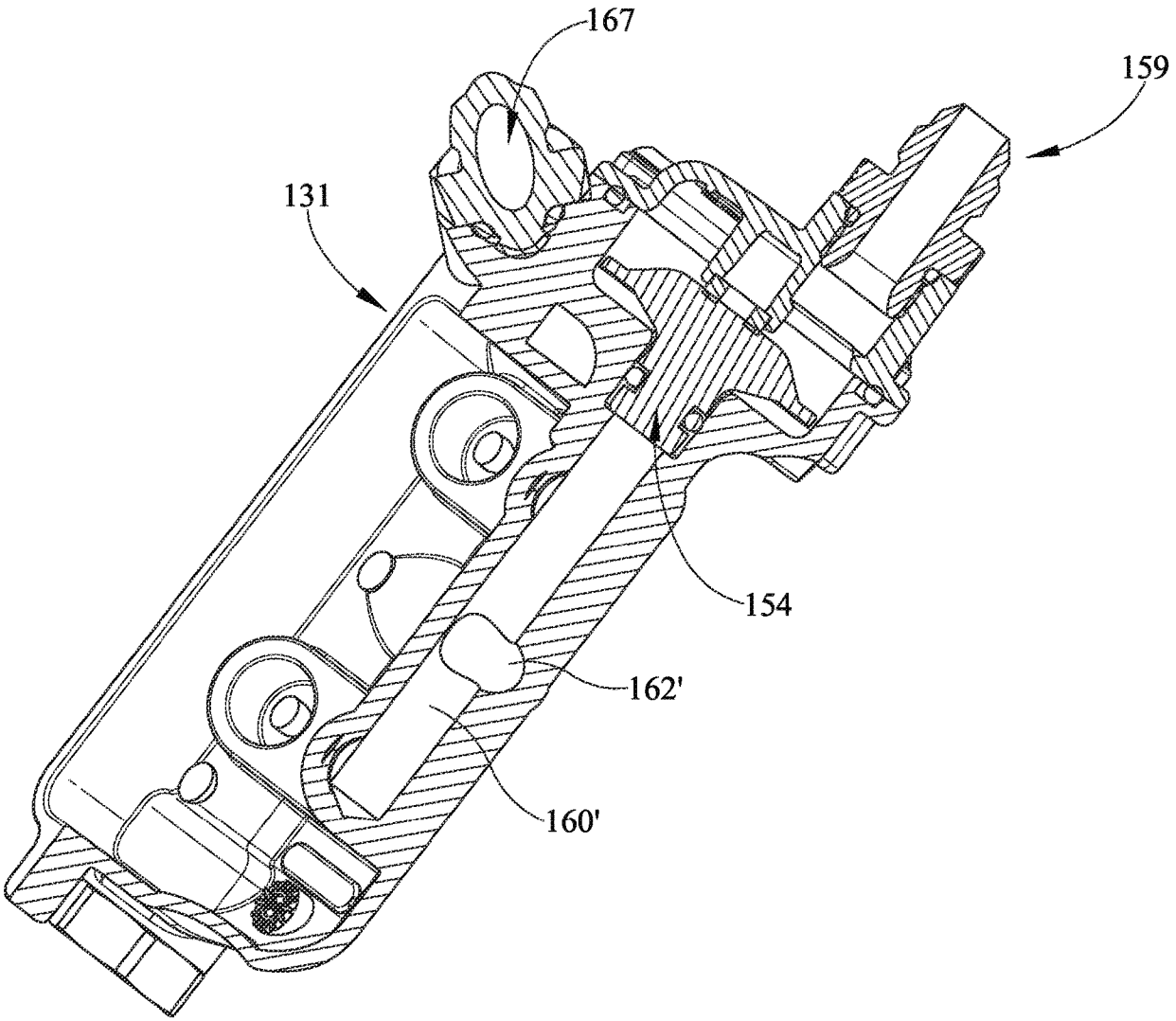
FIG. 10 is an angled section view of the fuel component cover of FIG. 9 which contains the pressure regulator.

Referring now to FIGS. 9 and 10, the pressure regulator 154 is shown and described. First, shown in FIG. 9, the regulator cover 166 is shown connected to a portion of the fuel component cover 131 which, in combination with the cover 166, houses the regulator 154 therein. The regulator cover 166 provides for a fuel outlet or port 159 through which fuel returns to a fuel tank of the vehicle. In some embodiments, the regulator 154 may not require any vacuum connection for operation. The regulator 154 is fully encapsulated by the fuel component cover 131 which protects the regulator 154 but also provides for ease of installation and manufacturing, in that once the fuel component cover 131 is installed, the regulator 154 is in place and ready for connection with return line to the fuel tank.

Also as shown in the end view, the port 159 may be positioned off-center relative to the cover 166. The cover 166 is also clockable, or rotatable, in 90 degrees increments to rotate the position of the port 159. The cover 166 may comprise one or more fasteners 165 which may be removed and reinstalled to rotate the cover 166 into a position wherein the port 159 does not interfere with other parts. Thus, depending on the surrounding equipment in the engine, the port 159 position may be altered so as to limit interference or otherwise increase clearance relative to either or both of the engine compartment or other engine components.

Also shown in FIG. 9 is a fitting 167 which is in fluid communication with the external crossover conduit 150. The fitting 167 may be of standard sizes according to SAE or ASME and provide fuel to the fuel component cover 131. Once the pressure builds in the fuel component cover 131 to a preselected value, the regulator 154 may open allowing fuel to return to the fuel tank.

With reference to FIG. 10, a section view of the fuel component cover 131 is depicted and sectioned through the regulator 154. As shown in this view, the fuel passes through fitting 167 and into an upper passage, before passing downward through passage 162' into a lower passage 160'. This flow is generally opposite, from the flow of previously described fuel component cover 132. One skilled in the art will appreciate that the regulator 154 may have one or more parts that open and close flow to the port 159, based on pressure within the fuel passages of the throttle body assembly 110.

Additionally, another advantage of the present assembly provides that the regulator 154 may be removable. This may be desirable if for example the regulator operates at a fixed, preselected value, but an end user would like a different operating pressure. In order to do so, the cover 166 may be removed and the regulator 154 may also be removed from inside the component cover 131. As a result, when the regulator 154 is removed, an alternate external regulator may be utilized and placed in fluid communication, direct or indirect, with the port 159. Further, no other plugs, fittings or other plumbing hardware is needed within the fuel component cover 131.

Figure 11A:
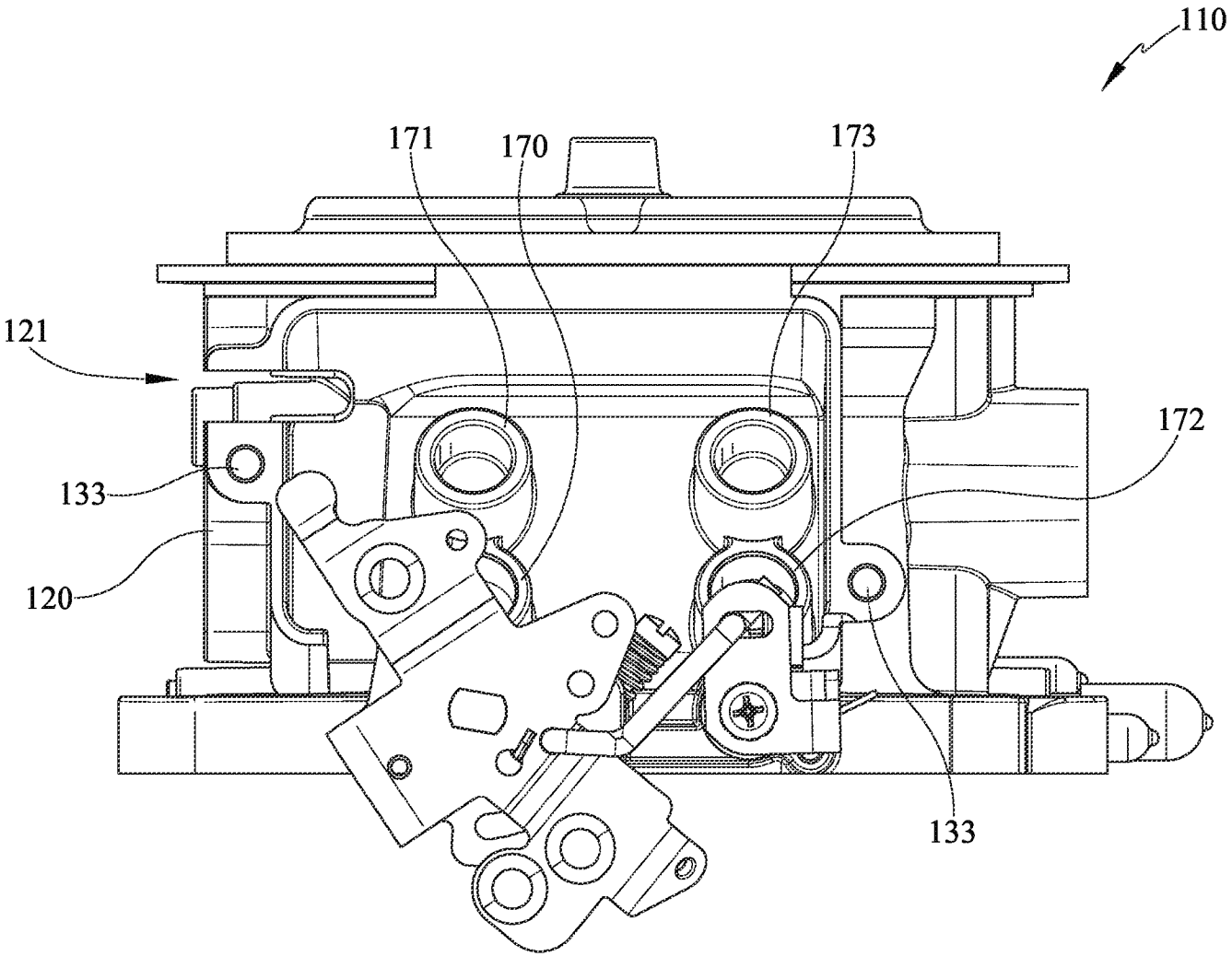
FIGS. 11*a* and 11*b* depict two sides of the electronic fuel injection throttle body assembly with the fuel component covers removed to depict wire routing areas.
Figure 11B:
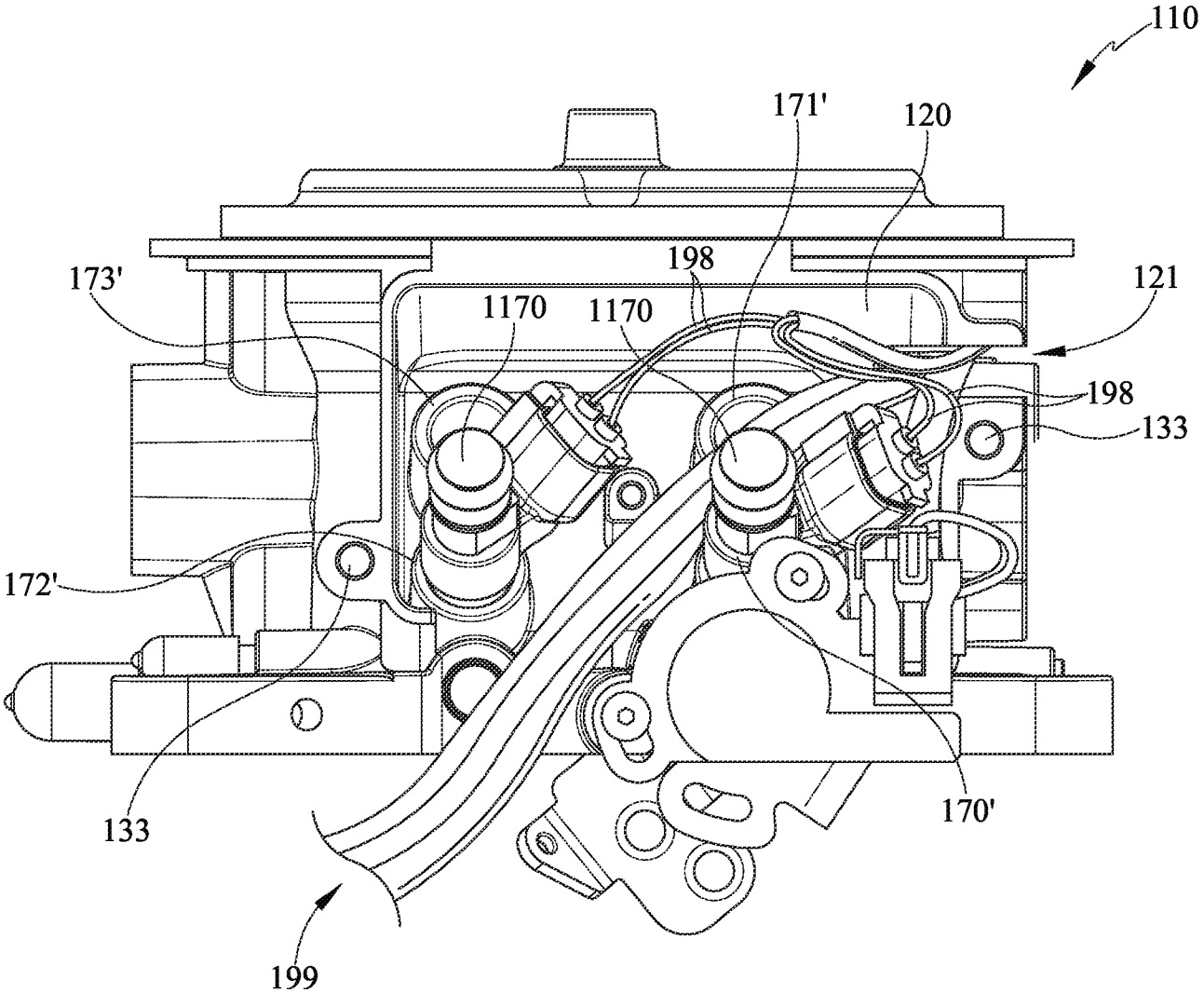
Figure 13:
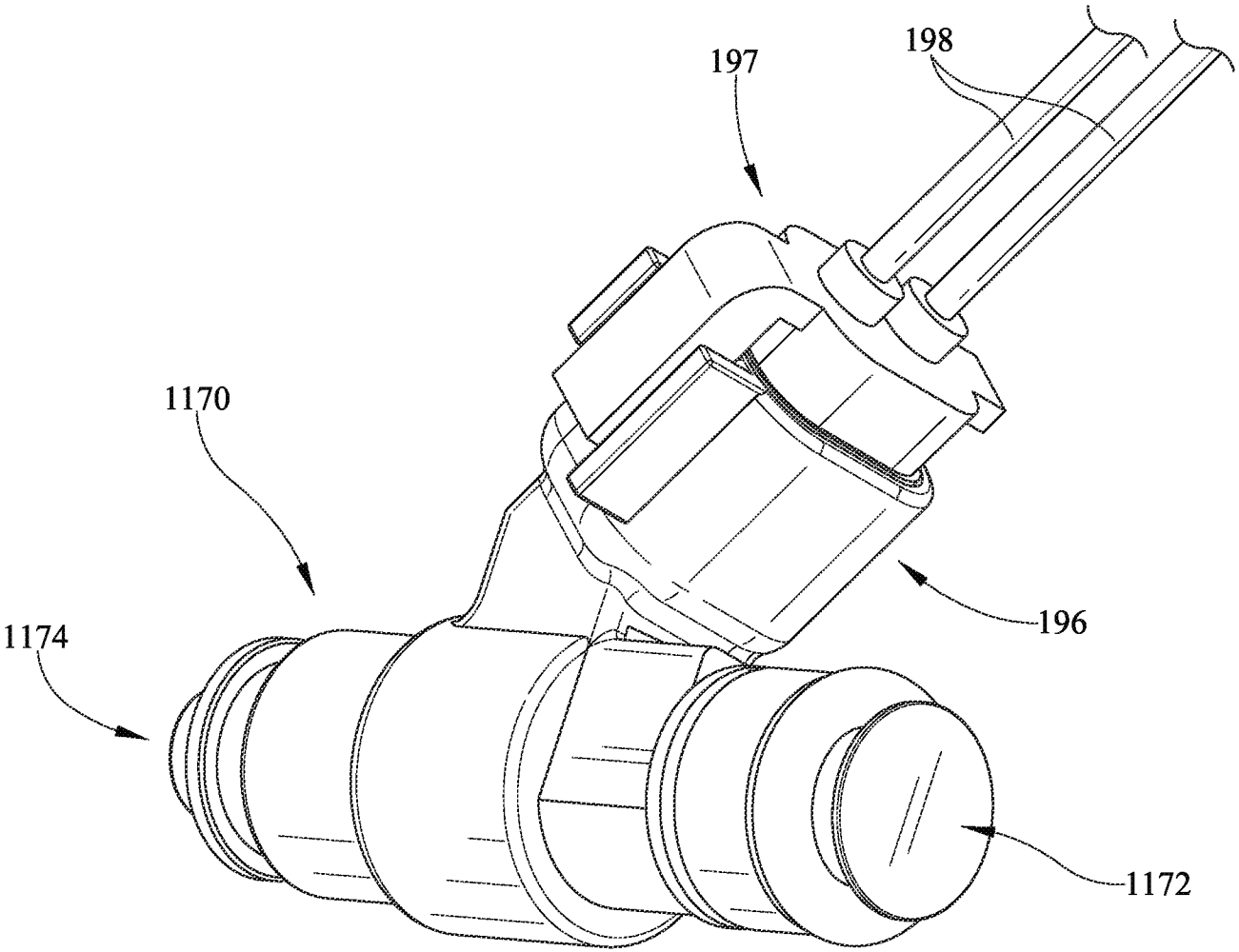

Referring to FIGS. 11*a* and 11*b*, two side views of the of the throttle body assembly 110 are shown. One advantage of the instant device is that the electronic control unit 190 is provided on the throttle body 120. Wires extend to the injectors 1170 of the injector ports 170, 171, 172, 173, etc., for control of the injectors by the ECU 190 (FIG. 12) as well as other wires 199 to other electronic components. For example, the additional wires 199 may communicate and/or power an IAC motor 193 (FIG. 4), a throttle position sensor 195 (FIG. 2), wiring harnesses, coolant temperature sensor and/or a handheld display or other devices/functionalities. It is desirable to manage wiring extending about the throttle body assembly 110 so as to inhibit contact with moving parts of the throttle body assembly 110 and the other moving parts within the engine. Also shown in this view are the connectors which are connected by wire to the ECU 190 (FIG. 12) and for communication between the ECU 190 the electronic fuel injectors 1170 (FIG. 13).

As shown in FIGS. 11*a*, 11*b*, first and second notches 121 may be formed in the throttle body 120. The notches 121 are located adjacent to the electronic control unit cover 130. The notches 121 are also adjacent to the fuel component covers 131, 132 such that wiring is located inwardly of the outer envelope of the throttle body 120. As a result, the position of the wiring is managed and the wiring is positioned behind the covers 130, 131, 132. Once behind the fuel component covers 131, 132, some wires may extend to the fuel injectors 1170 and others may extend further around the throttle body. For those wires extending further, and with additional reference to FIG. 4, a lower wire tray 180 is provided and formed integrally with one or both of the fuel component covers and the throttle body 120.

Also depicted in FIGS. 11*a*, 11*b*, the stacked arrangement of fuel injection ports 170, 171, 172, 173 and 170', 171', 172' and 173'. The ports are arranged vertically and stacked directly on top of one another. The pair of vertical ports 170, 171 are aligned with a centerline of the bores 140 such that the fuel injectors 1170 are also aligned with the center lines of the respective bores 140. The ports are shown angled downwardly relative to the throttle body 120. In other embodiments, the angle may be varied to be horizontal or upward and the firing angle of the fuel may be at the center of the bore 140 or alternatively, off center.

Still further, FIGS. 11*a*, 11*b* also show fastener locations 133 in the throttle body 120 for attaching the fuel component covers 131, 132. The fastening locations 133 are offset from one another in vertical directions. That is, a horizontal line extending right to left, or vice versa, through each of the fastener holes are parallel rather than aligned. This offset is beneficial to prevent any twisting of the component covers. With the additional view of FIG. 2, the cover 130 is also shown with fasteners offset from the locations and associated fasteners of the fuel component covers 131, 132, so that the adjacent fasteners can pass into the throttle body 120 without interference from one another.

Still further, the views show the distinction between the fuel injection ports 170-173 and 170'-173' and the injectors 1170. In FIG. 11*a*, the ports are all empty of injectors, however FIG. 11*b* includes injectors 1170, which are shown in two of the four ports shown. The injectors 1170 are inserted based on size of the engine and/or performance requirements. When larger engines are utilized and higher horsepower is required, more injectors 1170 may be desirable. Practically speaking, and merely for non-limiting example, the throttle body 120 may be cast for example with two ports per bore 140, in the stacked vertical arrangement already described. During subsequent manufacturing, depending on the need for one injector or two injectors per bore, the additional bore injector may be machined to accept an injector. Thus, for example, the lower ports of each bore 140 may be machined to receive an injector after casting, but if a cast throttle body will be manufactured into a two ports per bore assembly 110, the second port of each bore may be machined so that it may also accept a fuel injector. Alternatively, the upper ports may be machined but if the additional port per barrel is desired, the lower second cast port (per bore) may be machined.

As an alternative, rather than not machining all of the cast ports of each bore, all of the ports could be machined but the unused ports could be closed with a plug. In future use, an end user or a manufacturer could subsequently unplug any plugged ports for use of additional fuel injectors.

Referring now to FIG. 12, a side section view of a portion of the throttle body assembly 110 is depicted. The section cuts through the electronic control unit cover 130 and reveals the electronic control unit 190. The cover 130 is connected to the throttle body 120, for example by fasteners or otherwise removably connected. The electronic control unit 190 may be a printed circuit board, and may further comprise memory to which operating code may be flashed. The electronic control unit 190 may be connected to the cover 130 for example by one or more fasteners and may also be potted to reduce effects of contaminants, water, noise, vibration or other environmental influences. Alternatively, the electronic control unit 190 may be connected to the throttle body 120 and then covered by the cover 130. The electronic control unit 190 or "controller" is used herein generally to describe various apparatus relating to the monitoring of engine data, user input and the performance of one or more actions in response to occurrence of certain engine sensor data or action from user. A controller can be implemented in numerous ways (e.g., such as with dedicated hardware) to perform various functions discussed herein. A "processor" is one example of a controller which employs one or more microprocessors that may be programmed using software (e.g., microcode) to perform various functions discussed herein. A controller may also include a printed circuit board and may be implemented with or without employing a processor, and also may be implemented as a combination of dedicated hardware to perform some functions and a processor (e.g., one or more programmed microprocessors and associated circuitry) to perform other functions. Examples of controller components that may be employed in various implementations include, but are not limited to, conventional microprocessors, application specific integrated circuits (ASICs), and field-programmable gate arrays (FPGAs).

In various implementations, a processor or controller may be associated with one or more storage media (generically referred to herein as "memory" e.g., volatile and non-volatile computer memory such as RAM, PROM, EPROM, and EEPROM, floppy disks, compact disks, optical disks, magnetic tape, etc.). In some implementations, the memory may be encoded with one or more programs that, when executed by the controller, perform at least some of the functions discussed herein. Memory may be fixed within a processor or controller or may be transportable, such that the one or more programs stored thereon can be loaded into a processor or controller so as to implement various aspects of implementations disclosed herein.

Also shown within the cavity between the cover 130 and the throttle body 120, is an intake air temperature (IAT) sensor 192. The IAT sensor 192 is operably connected to the electronic control unit 190, either by wired connection or by plug on the printed circuit board. The IAT sensor 192 extends through a hole in the throttle body toward the bore 140. The IAT sensor 192 does not extend through bore 140 and therefore does not substantively alter airflow characteristics of air moving through the bore 140. An o-ring or other sealing feature may be used with the IAT sensor 192 to inhibit moisture from entering the cavity along the IAT 192 wherein the ECU 190 is located. The IAT 192 is internal and integrated with the ECU 190, again for ease of installation by the end user, and with less likelihood of damage to the IAT 192.

Below the ring 252, the throttle shaft 138 and the valve plate 139. With additional reference to FIG. 5, the shaft 138 is shown with the plate 139 disposed thereon in the bore 140. The shaft 138 is slabbed or cut to have a flat area wherein the plate 139 may be seated and fastened. The fasteners are shown fastening from below as this eases installation, however this is merely illustrative and non-limiting. When the throttle lever assembly 136 causes rotation of the shaft 138, the plate 139 rotates therewith to open or close the bore, depending on the action of the driver. On the backside of the shaft 138 of FIG. 5 and to the left of the shaft 138 of FIG. 12, a second shaft 147 (FIG. 3) may be used, with plates to open and close the four bore or four barrel configuration. With brief additional reference to FIG. 2, a throttle link 141 is shown. In the instant embodiment, the throttle link 141 is fixed and not adjustable. However in other embodiments, this throttle link 141 may be adjustable. The throttle link 141 may extend to a second lever which rotates a second shaft.

With reference to FIG. 13, fuel injector 1170 is shown in perspective view. As referenced earlier, the fuel injector 1170 is shown in this view but is removed from other views for clarity. Each of the fuel injector ports 170-173, 170'-173' may have an injector 1170 located therein. The injectors 1170 direct fuel into the bores 140, by way of the rings 152, 252, for mixture with air moving into the bores 140. Each of the injectors receives fuel as a first end 1172 from the fuel passages in the covers 131, 132 and injects fuel from the second end 1174 into the bore 140.

Extending from the injectors 1170 are wired connectors 197 and wires 198 which extend to the electronic control unit 190. The connector 197 connects to a connector 196 which is in electrical communication with the injector 1170. Through this wired connection with the electronic control unit 190, the injector 1170 may be directed to inject fuel by the ECU 190. The remainder of the wires are hidden by the component covers 131, 132 and routed behind the covers where possible.

One skilled in the art should now understand that the electronic fuel injection throttle body assembly 110 also comprises modular applications. By defining many common mounting points and features for the various throttle body subassemblies such as fuel component covers, main bodies, electronic control units, rings and injectors, interchangeability is increased which allows engineers to mix and match the subassemblies to create new throttle body assemblies for new applications.

These new applications may be desired to increase airflow, fuel capacity, fuel inlet/outlet plumbing configurations and mounting locations of various subcomponents to clear other external obstacles (such as air cleaner assemblies). These different applications may be further defined by characteristics such as engine size or configuration, which includes throttle bore number, size, orientation or mounting interface. The applications and characteristics may, in turn, dictate the size, number and placement and potentially concealment of the fuel injectors (if employed), the placement of the ECU (if employed) as well as the inclusion of an internal and/or integral fuel pressure regulator.

The modularity or interchangeability of parts (like a fuel component cover 131,132) allows for use on a 4 barrel throttle body or a 2 barrel versions to reduce engineering, tooling and manufacturing costs. This provides maximum flexibility to build variations of interchangeable parts that differ in size, fuel capacity, etc.

With this in mind, it may be desirable to provide modular features for the throttle body assembly to meet any number or combination of these desired characteristics and/or applications. For example, the position and number of fuel injectors may vary. As described previously, various number of injector ports may be cast or formed, but not all used in each application. Further, to deliver fuel to the fuel injectors, the fuel component covers may also be formed to deliver fuel to upper, lower or both elevation fuel injectors depending on the applications requirements.

Further, the throttle body 120 may also be machined to be used as an air valve only. That is, no injector ports, no fuel routed through the assembly. In this embodiment, separate fuel component covers function to provide wire/cable retention and concealment covers, providing same mounting pattern as fuel component covers 131, 132.

Further, regardless of injector configuration, the modular throttle body 120 may be machined in a fashion such that the electronic control unit 190 may or may not be mounted on the throttle body 120. Alternatively, the ECU may be mounted in the cover 130, or still further may be located remotely with a blank cover mounted on the throttle body 120.

Interchangeability of components also lends itself in the multiple assembly application front to back on an existing intake manifold. This is also referred to as a 2×4 application.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the invent of embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teaching(s) is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms. The indefinite articles "a" and "an," as used herein in the specification and in the claims, unless clearly indicated to the contrary, should be understood to mean "at least one." The phrase "and/or," as used herein in the specification and in the claims, should be understood to mean "either or both" of the elements so conjoined, i.e., elements that are conjunctively present in some cases and disjunctively present in other cases.

Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

The foregoing description of methods and embodiments of the invention has been presented for purposes of illustration. It is not intended to be exhaustive or to limit the claims to the precise steps and/or forms disclosed, and obviously many modifications and variations are possible in light of the above teaching. It is intended that the scope of the embodiments and all equivalents be defined by the claims appended hereto.

What is claimed is:

1. An electronic fuel injection throttle body assembly, comprising:

a throttle body having an upper inlet and a lower outlet, said throttle body configured to mount to an internal combustion engine;

a plurality of bores disposed between said upper inlet and said lower outlet;

each of said plurality of bores having a first fuel injector and a second fuel injector disposed above said first fuel injector; and, a first fuel component cover having a lower fuel passage, an upper fuel passage, and a connecting fuel passage extending between the lower and upper fuel passages, wherein the upper fuel passage is in fluid communication with said second fuel injector and said connecting fuel passage located between the first and second fuel injectors of one bore and the first and second fuel injectors of a second bore;

said first fuel component cover providing fuel to two bores of said plurality of bores.

2. The electronic fuel injection throttle body assembly of claim 1, further comprising a second fuel component cover positioned on said throttle body opposite said first fuel component cover.

3. The electronic fuel injection throttle body assembly of claim 2, said second fuel component cover providing fuel to third and fourth bores of said plurality of bores.

4. The electronic fuel injection throttle body assembly of claim 3 further comprising an external fuel conduit extending between the first fuel component cover and the second fuel component cover.

5. The electronic fuel injection throttle body assembly of claim 2, further comprising an electronic control unit disposed on a side of said throttle body between said first fuel component cover and said second fuel component cover.

6. The electronic fuel injection throttle body assembly of claim 1, further comprising a port in each bore of said plurality of bores, each of said port corresponding to one of said first and second fuel injectors.

7. An electronic fuel injection throttle body assembly, comprising:

a throttle body having an inlet and an outlet, said throttle body being connectable to an internal combustion engine;

at least two bores which each have a first fuel injector in a first port and a second port which is capable of being machined for receipt of a second fuel injector, said second port disposed above said first fuel injector; and, a first fuel component cover positioned on said throttle body and adjacent to said at least two bores, said first fuel component cover having a lower fuel passage to provide fuel to each of said first fuel injector of each of said at least two bores, an upper fuel passage to provide fuel to each said second port when said second fuel injector is utilized, and a connecting passage extending between said lower fuel passage and said upper fuel passage;

said first fuel component cover providing fuel to said at least two bores.

8. The electronic fuel injection throttle body assembly of claim 7, further comprising a second fuel component cover.

9. The electronic fuel injection throttle body assembly of claim 8, said second fuel component cover positioned on an opposite side of said throttle body from said first fuel component cover.

10. The electronic fuel injection throttle body assembly of claim 8, further comprising an electronic control unit disposed on a side of said throttle body between said first fuel component cover and said second fuel component cover.

11. The electronic fuel injection throttle body assembly of claim 8, further comprising an external fuel conduit extending between the first fuel component cover and the second fuel component cover.

12. The electronic fuel injection throttle body assembly of claim 8, said first and second ports being disposed at an angle to a horizontal direction.

13. The electronic fuel injection throttle body assembly of claim 7, further comprising at least one fuel distribution ring in fluid communication with said first fuel injector.

14. The electronic fuel injection throttle body assembly of claim 13, said at least one fuel distribution ring being in communication with said second fuel injector if said second fuel injector is utilized.

15. An electronic fuel injection throttle body, comprising:

a throttle body having an inlet and an outlet, said throttle body being connectable to an internal combustion engine;

at least a first two bores on one side of said throttle body and at least a second two bores on a second side of said throttle body;

each bore of said at least a first two bores and said at least a second two bores each have a first fuel injector and a second port which is capable of being machined for receipt of a second fuel injector, said second port disposed above said first fuel injector;

a first fuel component cover positioned on said throttle body and adjacent to said at least first two bores;

a second fuel component cover positioned on said throttle body and adjacent to said at least second two bores;

said first and second fuel component covers each having a lower fuel passage to provide fuel to each of said first fuel injector of each of said at least first two bores and said at least second two bores, an upper fuel passage to provide fuel to each said second port when said second fuel injector is utilized, and a connecting passage extending between said lower fuel passage and said upper fuel passage; and, an external conduit extending between said first fuel component cover and said second fuel component cover.

* * * * *